United States Patent [19]

Esch

[11] 3,976,155

[45] Aug. 24, 1976

[54] TILE LAYING CART

[76] Inventor: Abner S. Esch, Box 500, R.D. No. 1, Bird-in-Hand, Pa. 17505

[22] Filed: June 27, 1975

[21] Appl. No.: 591,150

[52] U.S. Cl. ..... 280/32.5; 280/79.1; 297/426

[51] Int. Cl.[2] ..... B25H 5/00

[58] Field of Search ..... 280/32.5, 32.6, 79.1 R, 280/79.1 A; 297/423, 426, 425, 431, 439, 187

[56] References Cited

UNITED STATES PATENTS

| | | | |
|---|---|---|---|
| 1,382,883 | 6/1921 | Ashbridge | 280/32.5 |
| 1,631,561 | 6/1927 | Symmes | 280/32.5 |
| 2,237,909 | 4/1941 | Lund | 297/187 |
| 2,969,245 | 1/1961 | Wilson | 280/79.1 A |
| 3,037,570 | 6/1962 | Olson | 280/32.5 |
| 3,361,224 | 1/1968 | McKim | 280/32.5 |

FOREIGN PATENTS OR APPLICATIONS

| | | | |
|---|---|---|---|
| 40,177 | 4/1926 | Denmark | 280/32.5 |

*Primary Examiner*—M. H. Wood, Jr.
*Assistant Examiner*—Jack D. Rubenstein
*Attorney, Agent, or Firm*—C. Hercus Just

[57] ABSTRACT

A tile laying cart comprising a simple base frame composed of a pair of elongated channel members connected in transversely spaced relationship and the opposite ends thereof comprising the forward and rearward ends of said cart, a chest and chin-supporting pad member which is narrower at the forward end than at the rearward end is mounted for vertical adjustment relative to and above the forward portion of said base frame member and the upper surface of said base frame member comprising a supporting means for a stack of tiles to dispose the same conveniently for access to the occupant of the cart. The rearward portion of the base frame member also supports a transverse knee-supporting pad member so that when a worker is disposed in kneeling position upon the knee-supporting pad member and chest-supporting pad member, the worker may propel the cart by operation of his toes while leaving both hands and arms free for manipulation incident to laying tiles.

8 Claims, 4 Drawing Figures

TILE LAYING CART

BACKGROUND OF THE INVENTION

Various types of worker-supporting mobile means have been devised heretofore. As typical examples of these, U.S. Pat. No. 1,184,487 to Peterson, dated May 23, 1960, shows a caster supported automobile creeper and this is a very common type of mobile worker-supporting means. U.S. Pat. No. 2,448,427, to Gordon, dated Aug. 31, 1948 discloses a knee pad dolly which may be used in a number of different types of occupations where it is desired to support only the knees and toes of a worker for example.

In more recent times, the agriculture implement industry has devised certain types of power-operated mobile devises for supporting workers while harvesting different types of crop. This type of device is represented by U.S. Pat. No. 3,037,570 to Olson, dated June 5, 1962 and a more recent U.S. Pat. No. 3,361,224, to McKim, dated Jan. 2, 1968. In Olson, a sort of bicycle seat pad, as well as stomach and chest supporting pads are provided while a worker kneels in the power-operated mobile unit while harvesting a crop, and in the McKim patent, the worker lies prone upon a supporting platform 25 while having both hands free for harvesting crops as the mobile unit is moved by power means along a field. Both of these devises are relatively complex and it is the principal purpose of the present invention to provide a relatively simple, preferably inexpensive type of tile-laying cart, details of which are not suggested by any of the foregoing art, as will be explained in detail hereinafter.

SUMMARY OF THE INVENTION

It is the principal object of the present invention to provide a relatively simple and inexpensive tile laying cart which includes features providing maximum comfort for the occupant and comprises a very simple base frame composed of a pair of elongated channels which have the open faces thereof extending downwardly, whereby the upper surfaces comprising the connecting flange of the channels are disposed so that the forward portions thereof comprise tile-receiving surfaces and above said forward portions the cart is provided with a chest and chin-supporting pad member which is vertically adjustable relative to the base frame by means of tubular upright members connected to said frame channel members a little forwardly of the rearward ends thereof for receiving, telescopially, downwardly extending tubular ends of a supporting frame upon which the chest and chin-supporting pad member is mounted, the rearward portion of said supporting frame comprising a transverse knee-supporting pad member, the opposite ends of which extend a short distance beyond the sides of the elongated channels of the base frame and swivel type caster members being connected to the lower surfaces of the projecting ends of said knee-supporting pad member, while forwrd caster type rollers are mounted in the forward ends of said channel members and are rotatable upon pivot axes extending between the side members of said channel members.

Another object of the invention is to form the chest and chin-supporting pad member with a forward extention or projection that is narrower than the rearward chest-supporting portion thereof so that the narrower portion is adapted conveniently to be engaged by the chin of the occupant without obstructing side vision and said chest and chin-supporting pad member being connected to a tubular supporting frame which is formed somewhat yoke-like diverging rearwardly and the ends thereof depending downwardly for telescopic reception within vertical members carried by the base frame.

It is a further object of the invention to provide the elevation of the knee-supporting pad member at a level at which the operator may be propelled while supported in kneeling position and resting upon the chest and chin-supporting member, propulsion being effected by the operator engaging his toes with the supporting floor surface, thereby leaving both hands and arms free for manipulation relative to laying tile.

Details of the foregoing objects and of the invention, as well as other objects thereof, are set forth in the following specification and illustrated in the accompanying drawing comprising a part thereof.

DETAILED DESCRIPTION

Figure 1:
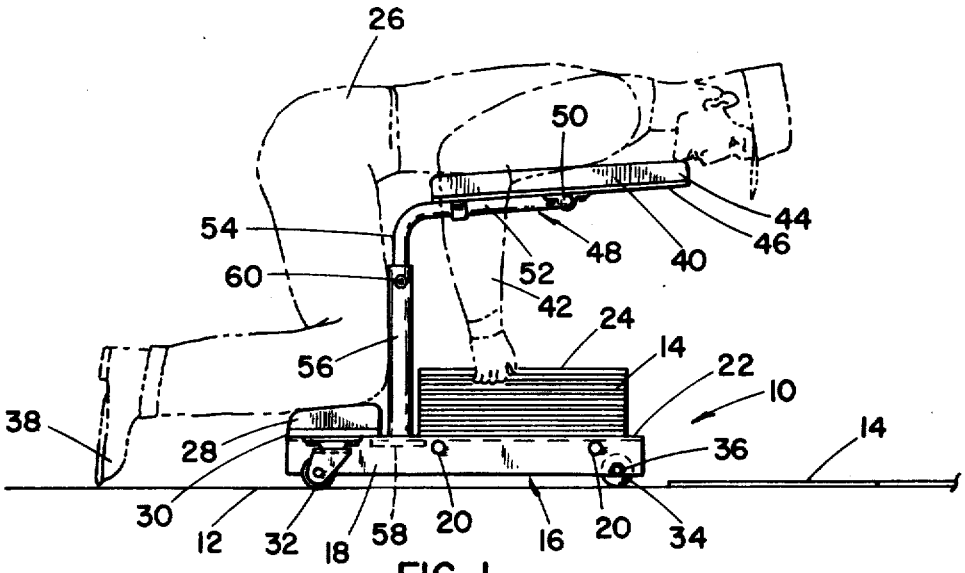
FIG. 1 is a side elevation of a tile laying cart embodying the principles of the present invention and illustrating a typical kneeling and chest and chin-supporting posture of a worker while using said cart.
Figure 2:
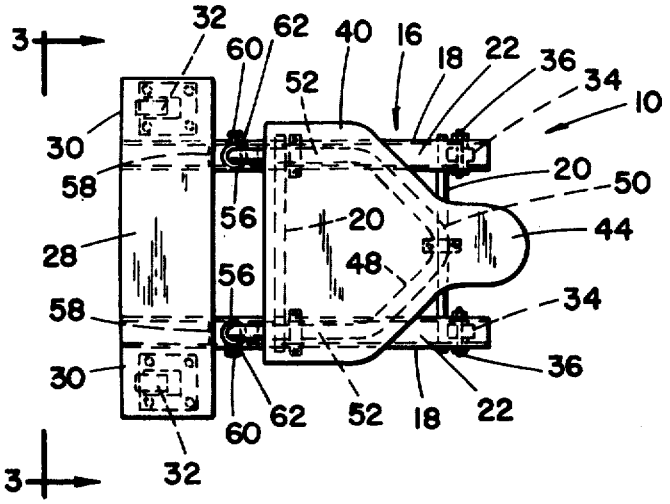
FIG. 2 is a top plan view of the cart illustrated in FIG. 1.

Referring to FIG. 1, it will be seen that the tile laying cart 10 which embodies the principles of the present invention is adapted to be supported in mobile fashion with respect to a surface such as the floor surface 12 upon which, for example tiles 14 are to be laid. It will be understood that the cart 10 may be supported upon the tiles which have already been laid upon the floor surface 12 or it may be supported directly upon the floor surface 12 on areas which have not yet received tile, as shown in FIG. 1. The cart 10 comprises a base frame 16 which primarily is formed from a pair of channel members 18, the open faces of which extend downwardly. As shown in FIG. 2, the channel members 18 are transversely spaced apart and are maintained in such position by a plurality of cross members such as rods 20 which, for convenience, may be inserted through appropriate holes formed in the side members of the channels 16 and the ends of the rods are appropriately fixed such as by welding the same to appropriate surfaces of said channel members.

By disposing the connecting flanges of the channel members 18 uppermost, it will be seen from FIG. 1 especially that the upper surfaces 22 of the channel members 18 are within a common horizontal plane and therefore very conveniently comprise in conjunction with each other highly effective supporting surfaces upon which a stack 24 of tiles 14 may be positioned for ready access to the occupant or worker 26. The portion of the channel members 18 upon which the stack 24 of the tiles are positioned is considered the forward end portion of the cart and the opposite end thereof is the rearward portion.

From FIGS. 1 and 2, it will be seen that the rearward portions of the upper surfaces 22 of the channel members 18 support a transversely extending knee-supporting pad member 28 which, preferably, is upholstered for the comfort of the worker 26. Any appropriate type of padding may be utilized in accordance with conventional upholstering techniques. From FIGS. 2 and 3, it also will be seen that the opposite ends 30 of the knee-supporting pad member 28 extend a limited distance beyond the opposite sides of the base frame 16 which primarily is composed of the channel members 18. Such extending ends 30 of the knee-supporting pad member afford stability to the cart in view of the fact that attached to the lower surfaces of said opposite ends 30 of the member 28 are a pair of caster-type supporting rollers 32 of the swivel type.

The forward end of the base frame 16 of the cart 10 is supported by a pair of caster-type rollers 34 which rotate upon fixed axes 36 to extend between the opposite sides of the channel members 18. For economy and simplicity, the rollers 34 may comprise conventional rollers such as employed in the manufacture of roller skates which preferably are of an anti-friction bearing nature. The swivel type supporting rollers 32 also preferably are of an anti-friction bearing type, whereby the cart may be propelled over a floor or tile surface with minimum effort such as by the toes 38 of a worker engaging such surfaces.

The worker-supporting aspect of the cart 10 also includes as a very important feature thereof the chest and chin-supporting pad member 40 which is substantially horizontal and preferably directly above the tile-supporting surfaces 22 of the members 18, whereby the arms 42 of the worker are free for use in the laying of tile. The shape of the pad member 40, in plan view, is best shown in FIG. 2. It will be seen that the rearward portion thereof is appreciably wider than the forward chin-supporting portion 44, a preferred type of operation thereof being illustrated in FIG. 1 in which the chin of the operator is resting upon the portion 44. It has been found that by such arrangement, considerable stability is afforded the worker 26 in the operation of laying tiles. This also results in minimum fatigue to the worker and, in addition, stabilizes the worker upon the cart for propelling the same in desired directions.

Figure 4:
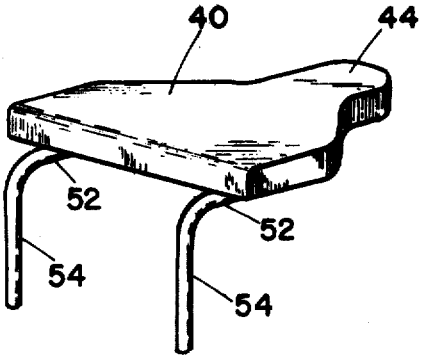
FIG. 4 is a perspective view of the chest and chin-supporting pad member and the supporting frame therefor, said view also showing the depending rearward ends of the supporting frame which are telescopically received in vertical tubular members extending upward from the base frame of the cart as illustrated in FIGS. 1–3.

The supporting pad member 40 and its chin-supporting portion 44 are suitably upholstered, said upholstery being applied to the upper surface of a base plate 46, which may comprise plywood or otherwise as is customary in many types of furniture upholstered structures, such arrangement also being employed in forming the knee-supporting pad member 28. The chest-supporting pad member 40 and its forward chin-supporting portion 44 are supported as a unit upon a supporting frame 48 which, in plan view, as shown in FIG. 4, has a forward, rounded pointed end 50 and the entire supporting frame 48 is preferably all unitary and is formed from suitable metal tubing such as steel, aluminum or otherwise. From the forward pointed end 50 of the frame 48, the same diverges in opposite directions and then said opposite portions extend rearwardly in parallel relationship as shown by the portions 52, said portions 52 terminating in downwardly bent, depending terminal end members 54.

Figure 3:
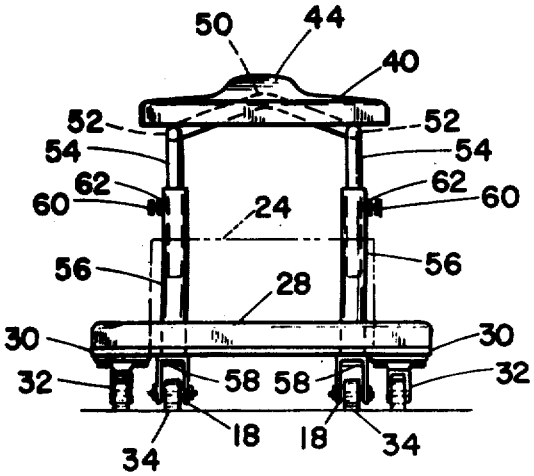
FIG. 3 is a rear vertical elevation of the cart shown in FIGS. 1 and 2 as seen as seen along the line 3—3 of FIG. 2.

The base frame 16 also is provided with a pair of similar vertical tubular members 56 which also preferably are formed from metal, such as steel. As illustrated in FIGS. 1–3, the depending members 54 of the supporting frame 48 telescope within the vertical tubular members 56 but, if desired, a reverse arrangement may be employed in the present invention, wherein the diameter of the members 54 would be greater than that of the members 56 and would receive the latter within the former. To provide rigidity and also securely attach the lower ends of the vertical members 56 to the channel members 18, the upper connecting flanges of the channel members 18 are provided with apertures through which the lower ends of the tubular members 56 extend. Disposed uppermost within the interior of channel members 18 are a pair of steel plates 58 which are best shown in FIGS. 1 and 3. These are welded or otherwise rigidly fixed to the inner surfaces of the uppermost connecting flanges of the channel members 18 and the lower ends of the tubular members 56 are welded to the plates 58. It has been found that this provides a highly satisfactory rigid connection of the vertical tubular members 56 to the base frame 16 and especially the channel members 18 thereof.

From the foregoing description, as well as the illustrations in FIGS. 1–3, it will be seen that the supporting frame 48 is vertically adjustable relative to the base frame 16 due to the telescopic relationship between the depending end members 54 of the supporting frame 18 and the vertical tubular members 56. To secure the supporting frame 48 in any desired vertical position above the base frame 16, very simple means are provided in the form of bolts or set screws 60 which are threaded within nuts 62, see FIGS. 2 and 3, which for example are welded to the outer surfaces of the vertical tubular members 56 and holes are drilled through the walls of the members 56 to permit the inner ends of the bolts or set screws 60 to engage the depending end members 54 of supporting frame 48.

From the foregoing, it will be seen that the present invention provides an extremely simple but highly mobile and energy-conserving tile laying cart which is provided with preferably upholstered cushion type supporting members for the knees, chest and chin of a tile laying worker so as to minimize fatigue from occurring and also enable the worker to have completely free use of their arms and hands for laying tile, a convenient supply of such a substantial number of tiles is capable of being supported by said cart and the cart is adapted to be held and guided by the toes and feet of the worker who occupies the cart, the readily swiveled rear supporting wheels of the cart enabling the worker to guide the cart in a highly effective manner, including turning it on short radii, if desired. For economy as well as convenience in operation, it has been found that the use and construction of the cart lends itself to being operated by the legs, feet and toes of the operator rather than being power driven and the particular manner in which the knees, chest and chin of the worker are comfortably supported contributes to the manipulation of the cart as well as rendering its use comfortable to the worker.

The construction of the cart is also such that it may be fabricated quickly and inexpensively from readily available material and the durable nature of the cart is conducive to long life, thereby adding to the economy thereof.

While the invention has been described and illustrated in its several preferred embodiments, it should be understood that the invention is not to be limited to the precise details herein illustrated and described since the same may be carried out in other ways falling within the scope of the invention as illustrated and described.

I claim:

1. A tile laying cart comprising in combination, a pair of elongated members, means extending between and fixed to said members to fix the same in spaced parallel relationship to form a base frame, pairs of caster-type supporting rollers mounted upon said frame adjacent the opposite ends thereof respectively comprising forward and rearward ends in use and said supporting rollers being mounted in transversely spaced relationship to each other to prevent tilting of said frame in use, similar vertical members fixed at one end to said elongated members intermediately of the ends thereof but closer to the rearward ends than the forward ends, a normally horizontal chest-supporting pad member having a narrower projection at the forward end thereof when in use positioned to support the chin of the occupant of the cart, a supporting frame member having a horizontal portion attached to the lower surface of said chest supporting pad member and also having a pair of projections depending from the rearward end of said supporting frame and engaging said vertical members for support thereby and vertically adjustable therewith to dispose said chest-supporting pad member above and parallel to the forward end portion of said frame at desired elevations, and a knee-supporting pad member extending across and fixed to the rearward end portions of said elongated members, the upper surfaces of the forward portions of said elongated members comprising tile supporting means adapted to receive a stack thereof between said members and said chest-supporting pad member and said supporting frame therefor.

2. The tile laying cart according to claim 1 in which the opposite ends of said knee-supporting pad member extends beyond the outer sides of said elongated members a predetermined distance and the rearward pair of caster-type supporting rollers being attached to the lower surfaces of said projecting end portions of said knee-supporting pad member and one of said pairs of caster-type supporting rollers being of the swivel type.

3. The tile laying cart according to claim 2 in which the pair of caster-type supporting rollers which are attached to the opposite projecting ends of said knee-supporting pad members are the swivel type supporting rollers.

4. The tile laying cart according to claim 1 in which said elongated members are channels having the open faces thereof disposed downwardly and the forward end portions of said channels receiving and supporting the rollers comprising the forward pair thereof, said rollers being supported upon axle members extending between the side walls of said channels.

5. The tile laying cart according to claim 1 in which said vertical members are tubular and said elongated members further including reinforcing plates secured therein adjacent the connecting flange portion of said channels, said connecting flanges having an aperature of suitable diameter to receive the lower ends of said vertical members and said lower ends being welded to said reinforcing plates in said channels to effect a rigid union of the lower ends of said vertical members relative to said channels.

6. The tile laying cart according to claim 1 in which said supporting frame for said chest-supporting pad member is formed from tubular stock and the forward end of said supporting frame is generally yoke-shaped and extending rearwardly, said depending projections of said tubular supporting frame being bent substantially perpendicularly from said yoke-shaped portion and extending downwardly therefrom, said similar vertical members being tubular and telescopically receiving said downwardly extending end portions of said supporting frame for said chest supporting pad member.

7. The tile laying cart according to cliam 6 in which the outermost tubular member of said telescopically related tubular members are provided with set screws threaded relative to the walls thereof and operable to engage the inner tubular member to secure said supporting frame for said chest-supporting pad member at a desired vertical position above said elongated members of said base frame.

8. The tile laying cart according to claim 1 in which the upper surfaces of said elongated members forwardly of said similar vertical members attached thereto comprise the connecting flanges for the side members of said channels, said connecting flanges being disposed uppermost and thereby providing smooth surfaces within a common horizontal plane and are free of obstruction to receive a supply of tile directly below said chest-supporting pad member and at a location readily accessible to the occupant of the cart when disposed thereon and supported by said chest-supporting pad member and knee-supporting member.

* * * * *